US007366058B2

(12) United States Patent
Marki et al.

(10) Patent No.: US 7,366,058 B2
(45) Date of Patent: Apr. 29, 2008

(54) GEAR FOR WATCH MOVEMENT

(75) Inventors: Eric Marki, Therwil (CH); Michiel Groothuis, St. Imier (CH)

(73) Assignee: Ronda AG, Lausen (CH)

( * ) Notice: Subject to any disclaimer, the term of this patent is extended or adjusted under 35 U.S.C. 154(b) by 0 days.

(21) Appl. No.: 11/315,798

(22) Filed: Dec. 22, 2005

(65) Prior Publication Data

US 2006/0098535 A1 May 11, 2006

Related U.S. Application Data

(63) Continuation of application No. PCT/EP2004/051053, filed on Jun. 7, 2004.

(30) Foreign Application Priority Data

Jun. 23, 2003 (CH) ..... 1094/03

(51) Int. Cl.
*G04B 19/02* (2006.01)
*G04B 19/20* (2006.01)

(52) U.S. Cl. ..... 368/220; 368/37; 74/434; 74/435; 74/437

(58) Field of Classification Search ..... 368/31–38, 368/80, 220, 221; 74/63, 434–468
See application file for complete search history.

(56) References Cited

U.S. PATENT DOCUMENTS 4,223,528 A * 9/1980 Vuilleumier ..... 368/220
5,432,759 A * 7/1995 Vaucher ..... 368/28
6,301,981 B1 * 10/2001 Oechslin ..... 74/1.5
6,802,645 B2 * 10/2004 Ludwig ..... 368/127
7,023,762 B1 * 4/2006 Burkhardt et al. ..... 368/35

FOREIGN PATENT DOCUMENTS

CH 680 630 10/1992

* cited by examiner

*Primary Examiner*—Vit W Miska
(74) *Attorney, Agent, or Firm*—Pearne & Gordon LLP

(57) ABSTRACT

Gear for day of the month display mechanism in a watch movement, including:

a driving organ (1), a driven organ (50), characterized in that said driving organ (1) is provided with z1 first teeth (120) and z2 second teeth (121), the height of the second teeth (121) being lower than the height of the first teeth (120), and in that said driven organ (50) is provided with z3 third teeth (501) and z4 fourth teeth (503), the height of the third teeth (501) being greater than the height of the fourth teeth (503), the height of the z1 first teeth (120) allowing the z3 third teeth (501) as well as the z4 fourth teeth (503) to be driven, the height of the z2 second teeth (121) allowing however only the z3 third teeth (501) but not the z4 fourth teeth (503) to be driven.

28 Claims, 5 Drawing Sheets

GEAR FOR WATCH MOVEMENT

The present invention concerns a gear for watch movement, in particular a gear used in a day of the month display mechanism for watch movement, in particular a high-number day of the month display mechanism.

In this description and in the claims, gear will be used to designate any system allowing a movement or a force to be transmitted between two toothed organs. The teeth of the driving organ penetrate between the teeth of the driven organ to transmit their movement. The gear organs can be constituted by rotating organs, for example wheels, pinions, ratchets, star wheels, rings with inner, external or axial gear teeth, etc. or by racks to transmit rectilinear movements.

The movements of mechanical watches and the movements with analogue displays, in particular, comprise a large number of gears. A train of gears actuated one by the other is sometimes called a gear train. In a watch movement, one can for example find a counting gear train, a time setting gear train, a reduction gear train for driving the hands of a quartz watch, etc.

In most gear trains, the relative angular position of the driving organ and of the driven organ matters little; one is thus not concerned to know which tooth of the driving organ actuates each tooth of the driven organ. During assembly of the gear, the two organs are thus mounted on their respective staffs so that their teeth interpenetrate mutually but without their angular position being controlled.

The angular position of the two organs of the gear can furthermore be sometimes modified. In the case of a shock, it can thus happen that a tooth of the driving organ is driven with sufficient energy to skip over a tooth of the driven organ without moving it. Besides, it also happens that the angular displacement by one step of the driving organ causes a greater indentation of the driven organ; this circumstance occurs notably when the linear pitch of the two gears is not identical, for example when the teeth of the driven organ are not separated from one another by the linear pitch of the driving organ and the driving organ is actuated with great energy.

Following these circumstances, the relative angular position of the two organs is modified. When the gear train serves only to multiply or reduce an angular movement, the consequences are generally insignificant, so that most conventional gears do not have any means to remedy this inconvenience.

This risk can also be reduced by providing a jumper to absorb and limit the rotation energy of the driven organ. A jumper thus allows the risk of the driven organ being driven beyond the desired indentation position to be reduced. This risk is however not entirely eliminated.

When the two organs of a gear each actuate a mobile with indications, it is sometimes important for the relative angular position of both organs to remain constant. For example, in the case of a display for high-number dates, it is frequent for the date's unit to be displayed by a first mobile whilst the tens are displayed by a second mobile driven by the first one. When the tens' mobile displays 0, the units' mobile runs through the sequence from 1 to 9. When the tens' mobile displays 1 or 2, the units' mobile must run through the sequence from 0 to 9. Finally, when the tens' mobile displays 3, the units' mobile must display the sequence 0 to 1 to display the $30^{th}$ and $31^{st}$ days of the month.

If the relative angular position of both mobiles is modified, for example after a shock or an excessively energetic time setting, the correspondence between the tens and the sequences of units can be corrupted. In this case, the date displayer could display combinations of tens and units that do not exist, for example the days of the month 32, 33, 34 etc. or skip valid digit combinations. A relative angular position of both mobiles can be re-established only by dismantling the gear and displacing one of the two gear organs to re-establish manually the relative angular position of both mobiles.

A similar problem arises notably in perpetual or semi-perpetual day of the month devices.

Patent application Ser. No. CH680630A3 describes for example a horological piece comprising a perpetual date mechanism each with two wheels having teeth of a first height and teeth of a second height, only the higher teeth of the driving wheel being capable of driving only the highest teeth of the driven wheel.

One aim of the present invention is to resolve the prior art problems mentioned here above.

Another aim is to propose a gear wherein each tooth of the driving organ always drives the same tooth of the driven organ.

Another aim is to propose a gear wherein each tooth of the driven organ is always driven by the same tooth of the driving organ.

Another aim is to propose a gear wherein, whatever the shocks sustained, certain teeth of the driving organ never gear with certain teeth of the driven organ.

Another aim is to propose a gear wherein the relative angular position of both organs can be re-established, if possible automatically, after a shock or an acceleration causing this relation to change.

Another aim is to propose a day of the month display for watch movement wherein at least certain days of the month are displayed with the aid of two mobiles and wherein the relative angular position of both mobiles is automatically corrected after accidental modifications.

Another aim is to prevent such accidental modifications of the relative angular position.

According to the invention, these aims are achieved by means of a gear and of a day of the month display mechanism comprising the characteristics of the claims of corresponding type, particular embodiments being further indicated in the dependent claims.

In particular, these aims are achieved by means of a gear for watch movement, including a driving organ provided with z1 first teeth and z2 second teeth. The height of the second teeth is lower than the height of the first teeth. The gear's driven organ is provided with z3 third teeth and z4 fourth teeth. The height of the third teeth is greater than the height of the fourth teeth. The heights and shapes of the teeth are designed so that the z1 first teeth can drive the z3 third teeth as well as the z4 fourth teeth, whilst the z2 second teeth allow only the z3 third teeth but not the z4 fourth teeth to be driven.

Thus, the short z4 teeth are always driven by one of the z1 long teeth of the driving organ. It can thus be guaranteed that, after a certain number of indexing steps, the two gear organs find themselves in one of the predefined possible relative angular positions.

If the driving organ has a single long tooth and that the driven organ has a single short tooth, it can thus be guaranteed that after a sufficient number of steps, this short tooth will be driven at each turn by the same long tooth of the driving organ. The relative angular position of the two organs thus remains constant.

The invention will be better understood by reading the description of an embodiment illustrated by the attached figures, in which.

Figure 3A:
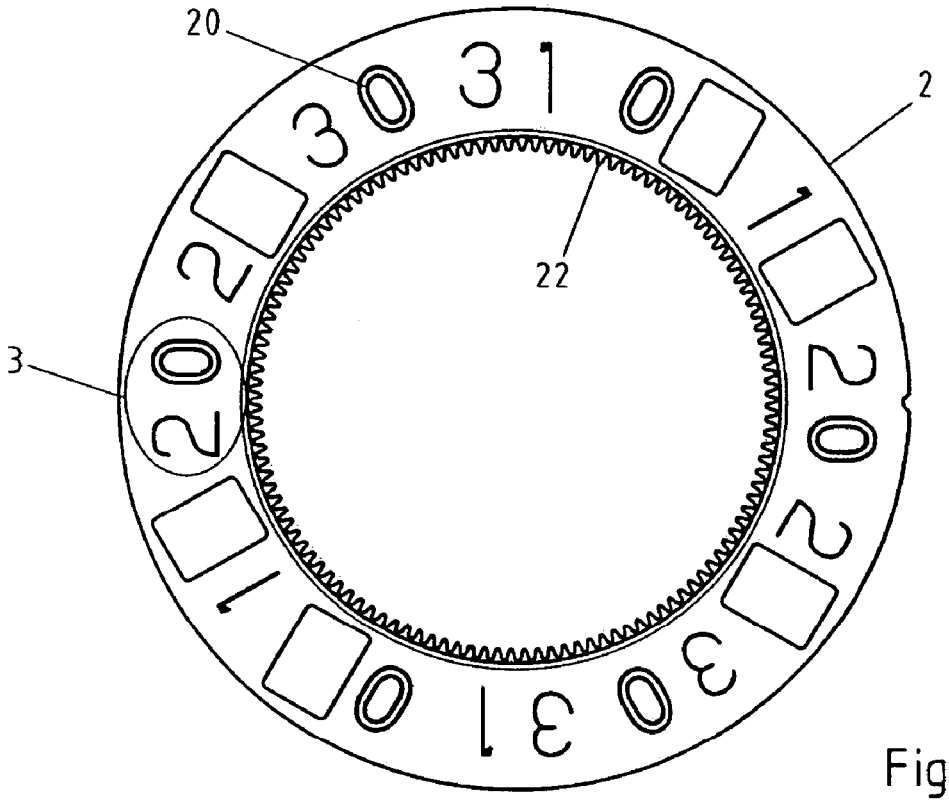

FIG. 3*a* shows a top view of the tens' disc in a variant embodiment of the invention.

Figure 3B:
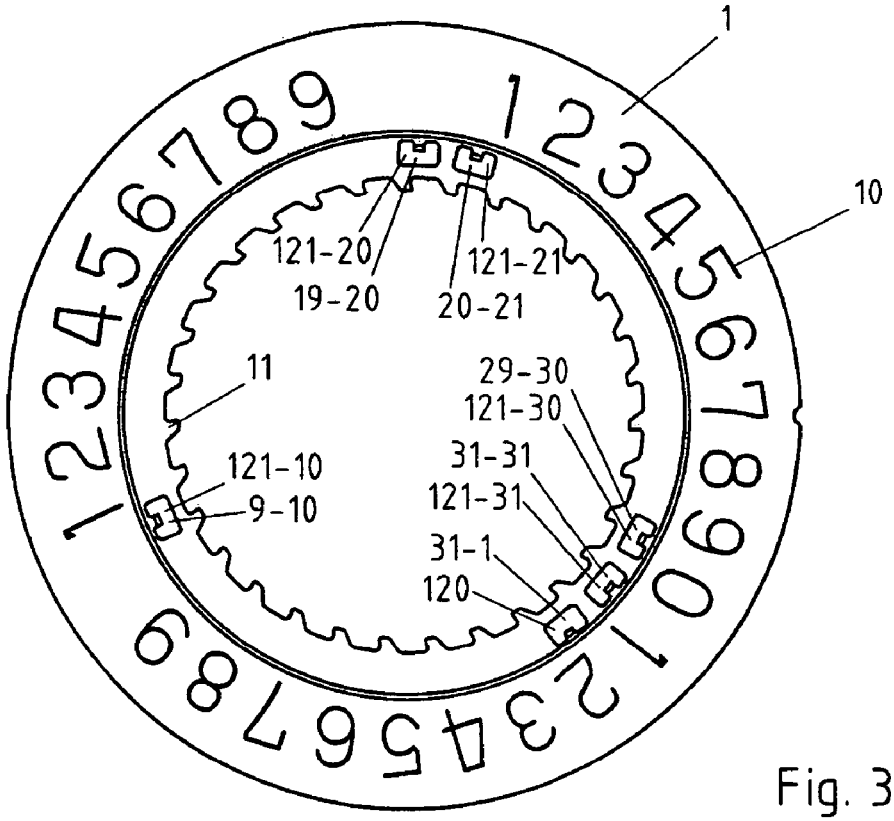

FIG. 3*b* shows a top view of the units' disc in a variant embodiment of the invention.

Figure 4:
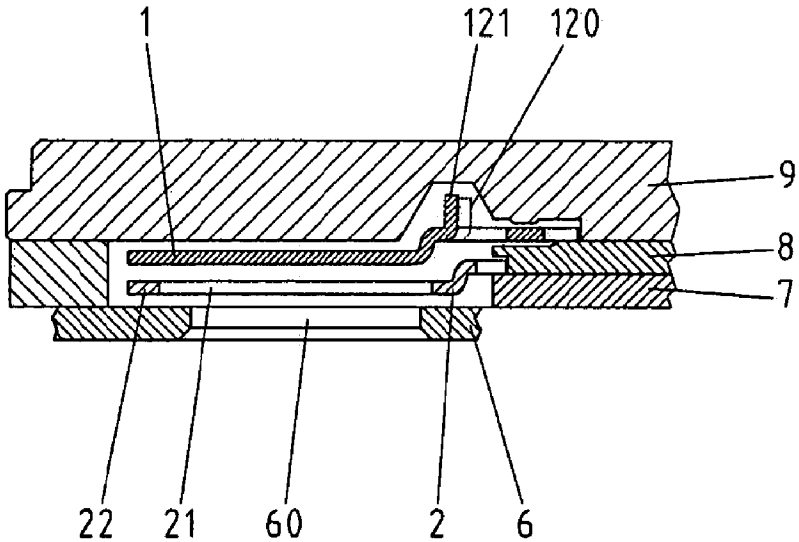

FIG. 4 shows a partial cross section along the axis IV-IV of the driving mechanism according to the invention.

Figure 5:
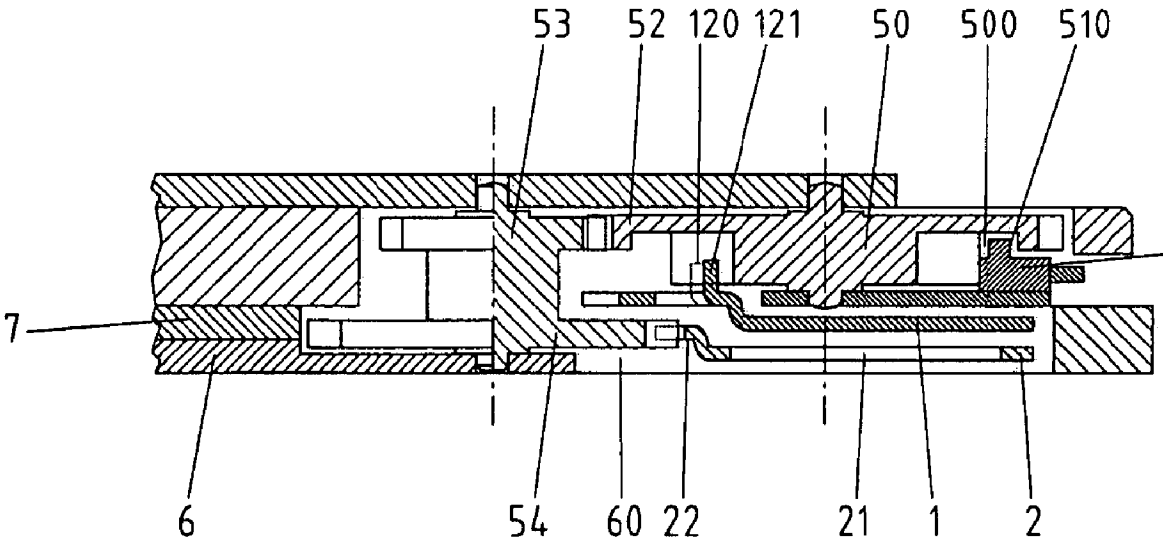

FIG. 5 shows a partial cross section along the axis V-V of the driving mechanism according to the invention.

Figure 6:
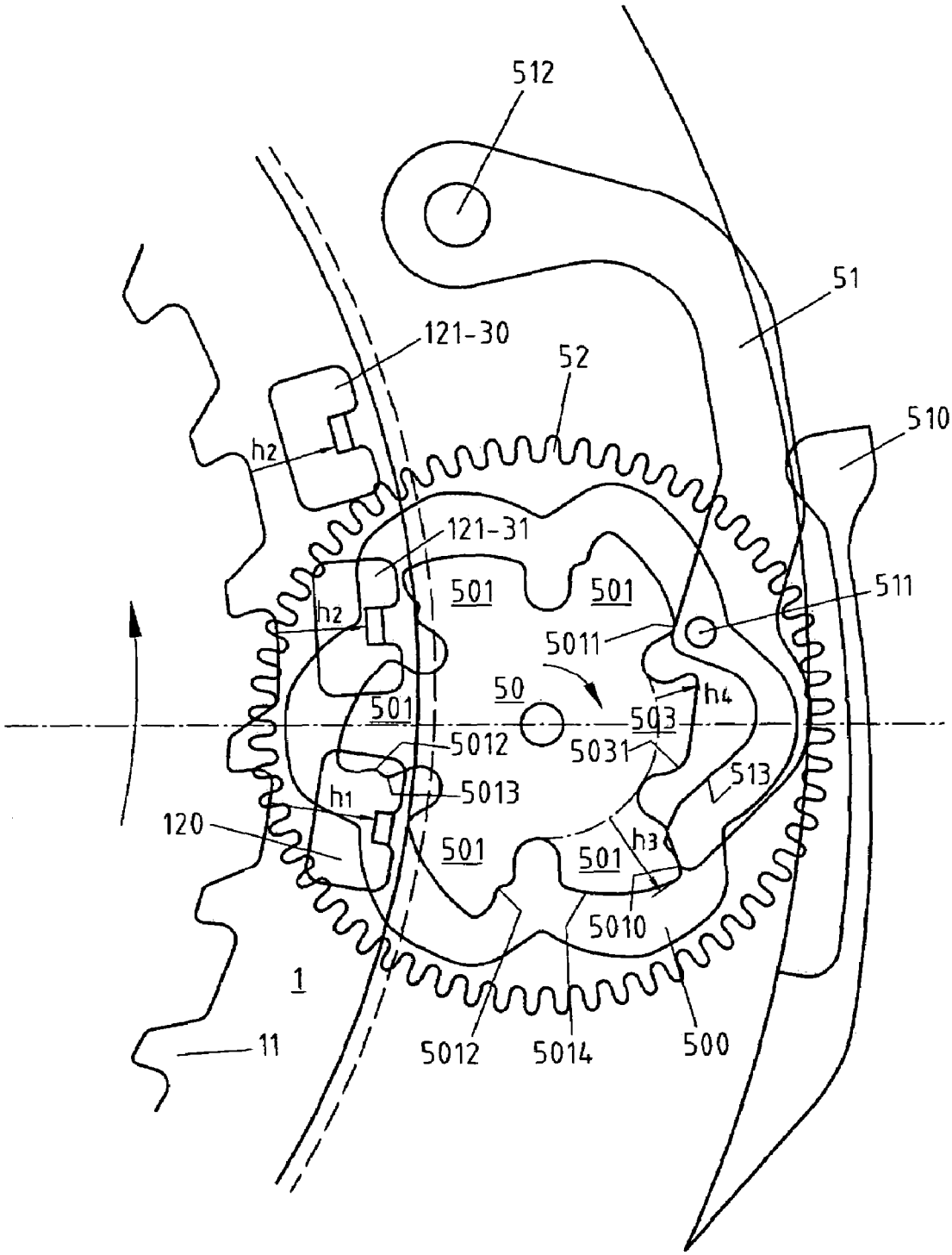

FIG. 6 illustrates the gear of the invention used in the inventive day of the month driving mechanism.

Figure 1:
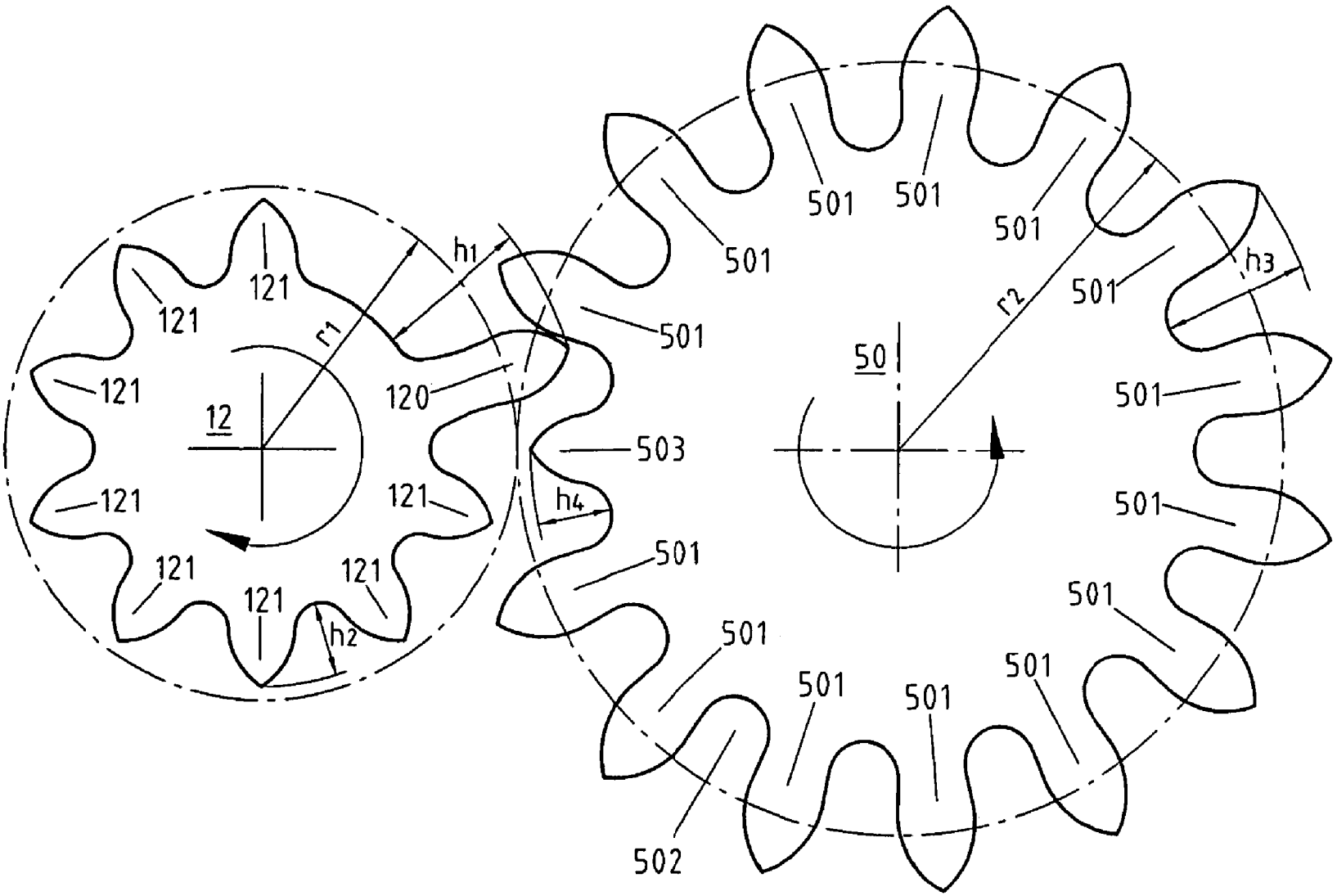
FIG. 1 shows a diagram of a gear according to the invention.

FIG. 1 illustrates a gear including a toothed driving wheel 12 with a primitive radius r1 and a driven wheel 50 with a primitive radius r2. According to the invention, the driving wheel 12 includes in this example z1=1 long tooth 120 and z2=9 shorter teeth 121. In this embodiment, the shape of the first teeth 120 and of the second teeth 121 is different. The height of the long teeth 120 is illustrated by the reference h1 whilst that of the short teeth 121 bears the reference h2. Furthermore, the pitch and linear pitch between the teeth are irregular; in this embodiment, a tooth seems to be missing. As to the driven wheel 50, it includes z3=14 long teeth 501 with a height h3 and z4=1 tooth 503 with a shorter height h4. The invention is however not limited to these particular values of z1, z2, z3 and z4; in particular, it is possible to provide several adjacent or not adjacent long teeth on the organ 12 and several adjacent or not adjacent short teeth on the organ 50.

In this embodiment, the teeth of the gear's organ 50 have the same pitch; the invention is also particularly useful in the case of gears with driven organs having irregular pitch and linear pitch.

The height and/or shape of the long tooth 120 of the wheel 12 allow the z3 long teeth as well as the short tooth 503 to be driven. Conversely, the height and/or shape of the z2 short teeth allow only the z3 long teeth but not the shorter tooth 503 to be driven. In the situation illustrated in FIG. 1, the long tooth 120 is ready to gear with the short tooth 503. However, if for any reason the driving wheel 12 should skip a tooth, i.e. if the tooth 120 should find itself beyond the tooth 503 without the latter having been driven, the driven short tooth 503 would find itself opposite z2 teeth too short to gear with it. In this case, the driving wheel 12 would perform a complete revolution before a long tooth 120 is capable of actuating the tooth 503. The relative angular position of the two wheels 12 and 50 is thus automatically re-established after z2 indexing steps.

Furthermore, since a tooth is missing after the long tooth 120, the driven organ 50 could be actuated by this tooth 120 with sufficient energy to be indented by two steps. A jumper on the organ 50 could limit, though not eliminate, this risk. In such a case, the relative phase position of both organs would be modified; the driven organ 50 would be in advance by one tooth. However, at the latest after one revolution, the short tooth 503 would find itself opposite a tooth 121 instead of being opposite the only long tooth 120 capable of actuating it. In this case, the organ 50 would have to let the driving organ turn by one step before the tooth 503 can be actuated; the relative position of both organs is thus also re-established after z2 indexing steps.

The inventive gear can be used each time, in a watch movement, the relative angular (or phase) position of the driving organ and of the driven organ must remain constant, or when this position cannot take on arbitrary values. An application of this gear to a day of the month driving mechanism in a high-number date display will now be described with the aid of FIGS. 2 to 6.

Figure 2:
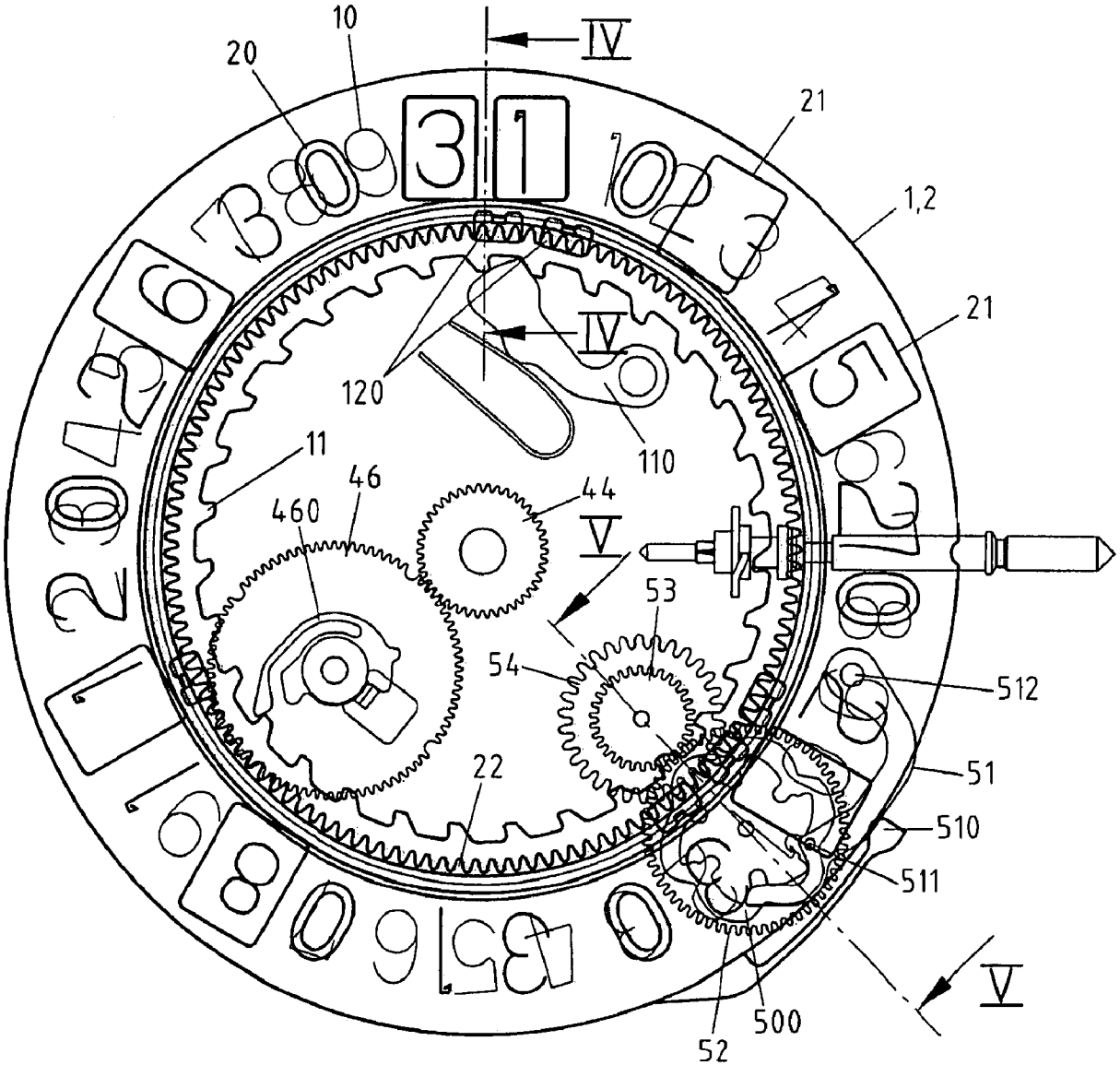
FIG. 2 shows a simplified view of the day of the month driving mechanism in a horological movement including a gear according to the invention.

The described date display mechanism uses two distinct mobiles 1 and 2, superimposed in FIG. 2 and illustrated separately in FIGS. 3*a* and 3*b*. The mobile 1 of FIG. 4*b* displays mainly the units whilst the mobile 2 illustrated in FIG. 3*a* includes mainly the tens of the days of the month; however, certain dates (in this example, the dates 20, 30 and 31) can be displayed by a single mobile. A mechanical or electromechanical control system allows each day the correct tens-units combination to be displayed through one or several apertures 60 in the dial 6 (FIGS. 4 and 5).

The first mobile 1, or units' disc, visible in FIG. 3*b*, bears a sequence of digits 10 {1,2,3,4,5,6,7,8,9,0,1,2,3,4,5,6,7,8,9,1,2,3,4,5,6,7,8,9}. The digits are regularly spaced with the exception of a greater interval between the second 9 and the third 1, and of a double interval between the last 9 and the first 1, the width of the intervals being sufficient to display a two-digit day of the month, as well be seen further below. In the illustrated embodiment, the days of the months are designed to be displayed at twelve o'clock on the dial; the units' digits are thus placed almost radially, so as to appear vertical when seen through a vertical aperture 50 just right of the twelve o'clock position. Other positions of the date display aperture or apertures are possible within the frame of this invention.

The second mobile, or tens' disc, is constituted by a second disc 2 turning concentrically over the units' disc 1, as can be seen in particular in FIGS. 4 and 5. It will be noted that in these figures, the dial 6 of the watch is on the bottom. As can be seen in particular in FIG. 3*a*, the second disc 2 bears in this embodiment the sequence {0,1,20,2,30,31,0,1,20,2,30,31}. A vertical window 21 is stamped through the tens' disc 2 on the right of the digits 0, 1 and 2, allowing the digits (reference 10) borne by the units' disc 1 to be visible.

The date 3 displayed through the aperture or apertures 60 in the dial thus generally correspond to the combination of a ten displayed by the mobile 2 and of a unit printed on the mobile 1 and seen through a window 21. The days of the month 20, 30 and 31, in this example, are however constituted each of two digits printed on the same mobile 2. The inventive display mechanism is thus a combination between a high-number date display mechanism, with two digits borne by two distinct mobiles, and a conventional date of the month display mechanism for other dates, for which the single digit or the two digits of the day of the month are borne by the same mobile. The disadvantages of the display by two distinct mobiles can thus be avoided, at least for certain dates, without having to give up the display of high-number days of the month.

The mechanism for driving the two mobiles 1, 2 will now be described with the aid of FIGS. 3, 4 and 5. In this embodiment, the two mobiles are driven by the same electromechanical or mechanic motor (not represented) and reset by the same winding crown; it would however also be possible to drive and/or set both mobiles by two independent motors or by a single motor but through two distinct cinematic chains.

With reference more particularly to FIG. 3, a pinion 44 actuated by a motor (not represented) drives a wheel 46, on the staff of which a ratchet device 460 is mounted and arranged so as to cause the internal gear teeth 11 of the units' disc 1 to rotate, each day, at midnight or at another moment. In this embodiment, the disc 1 is thus indexed each day by 360/31 degrees so as to perform one revolution for every month of 31 days. Other indexing steps are possible, for example in the case of a perpetual display. A jumper 110 restraints the internal gear teeth 11.

It would also be possible within the frame of this invention to conceive mechanisms in which the change of date would not occur at midnight, as well as mechanisms in which the disc 1 performs a revolution during a period different from 31 days .

The units' disc 1 comprises teeth, formed in this example by driving bankings 120, 121 constituted by protruding portions of the disc 1, here portions folded back by stamping. Several close teeth can be constituted by a same folded-back portion. These bankings allow a gear element 50 to be indexed, in this embodiment a star wheel with six unequal teeth or branches, indexed by 60° at each contact with the bankings 120, 121. The bankings 120, 121 are placed radially on the disc 1 so that a banking actuates the star wheel 50 each time a rotation of the ten's disc 2 is desired. In the illustrated embodiment, the units' disc 1 comprises six irregularly spaced bankings 120, 121, to displace the tens' disc six times per month:

- on the $10^{th}$ of the month, under the action of the tooth 121-10, when passing from the ten 0 to the ten 1;
- on the $20^{th}$, under the action of the tooth 121-20, when passing from the ten 1 to the ten 2;
- on the $21^{st}$, under the action of the tooth 121-21, when passing from the $20^{th}$ to the $21^{st}$;
- on the $30^{th}$, under the action of the tooth 121-30, when passing from the ten 2 to 30;
- on the $31^{st}$, under the action of the tooth 121-31, when passing from the $30^{th}$ to the $31^{st}$; and
- on the $1^{st}$, under the action of the shortest tooth 120, when passing from the $31^{st}$ to the ten 0.

The linear pitch of the teeth 120, 121 on the units' disc is thus irregular and different from the linear pitch of the teeth of the star wheel 50; in this example, teeth are missing on the driving organ.

The star wheel 50 drives at each rotation a wheel 52 mounted on the same staff, which itself actuates a wheel 53. The wheel 53 is mounted on the staff of a wheel 54 gearing with the internal gear teeth 22 of the tens' disc 2. The gearing ratio between the wheels 50 and 53 is chosen so that the indexing angle of the tens' disc 2 caused by a displacement of the star 50 corresponds to the angular distance between two tens' digits.

The star wheel 50 is held by a jumper 51 pressing against the interstice 502 between two teeth 501 of the star 50 by a spring 510. The jumper makes it possible to prevent the star wheel 50 from turning freely, in particular when it is driven by a tooth 120, 121. The construction and operation of the jumper will be described in more detail further below in relation with FIG. 6.

As can be seen in particular in FIG. 4, the first mobile 1 slides directly on the upper bridge 9 of the watch movement, and is held by a first plate 8 mounted over this bridge. The second mobile 2 slides on a ring path over this first plate 8 and is held by a second plate 7. The dial 6 is fastened over the second plate and provided with an aperture 60 to display the days of the month borne by the first and/or second mobile.

The mechanism for correcting the relative angular position of the two mobiles 1 and 2 will now be described with the aid of FIG. 6.

During shocks or very energetic rewinding or resetting, it can happen that a banking 120, 121 or tooth of the units' disc 1 drives the star wheel 50 with an energy such that despite the jumper 51 and the pin 511, the star wheel is indented by several steps. This risk could be limited, though not entirely eliminated, by using a stronger jumper spring to press on the teeth 50. This solution would however have the disadvantage o requiring considerably power and energy, which could prejudice the watch's power reserve and the size of its motor organs.

Following such an incident, the relative angular position of the tens' disc 2 is shifted relatively to that of the units' disc 1. Consequently, the sequences of units run through no longer correspond to the tens displayed opposite; the movement for example will run the dates 31, 32, 33, 34 etc. or jump directly from the $1^{st}$ to the $11^{th}$ of the month. If no correction mechanism were provided, it would be necessary in order to remedy this unfortunate situation to dismantle the movement and replace manually the star wheel 50 in the desired angular position.

According to the invention, the teeth 120, 121 of the units' mobile have the heights h1, h2 and possibly different shapes or positions, as can be seen more particularly in FIG. 6. In particular, the first tooth (or banking) 120 of the units' disc is higher than the other teeth 121.

In fact, in the illustrated example, the size of the catches 120 and 121 is possibly identical, but their distance to the center of the disc is different. The height h1, h2 of the teeth 120, 121 thus depends on the summit of their projection on a plane parallel to the movement's bottom; a tooth 120 is considered high because it passes close to the center of the star wheel 50 than the teeth 121.

Similarly, the teeth of the star wheel 50 have heights h3 and h4 and shapes that vary, the teeth 501 being higher than the tooth 503.

As explained above, the catches 120, 121 are placed in the illustrated embodiment at irregular distances in order to gear the star wheel 50 only on the days where an indentation of the tens' disc is necessary. The linear pitch between the existing catches 120, 121 is furthermore preferably variable in order to obtain an optimum contact angle between any combination of teeth 120 or 121 and the portions 5012, 5013 of the teeth 501, 503. The catches 120, 121 are thus not placed at angular positions separated by multiples of the gear pitch.

The height h2 of the short teeth 121 does not allow them to gear with the single short tooth 503 of the star wheel 50. In this manner, when the star wheel 50 and the tens' disc 2 are accidentally incremented by one of the catches 121 of two steps instead of a single one, the short tooth 503 finds itself facing a short catch 121. In this position, not represented, the star wheel 50 is no longer driven. The tens' disc 2 can only be actuated when, after a sufficient number of incrementations of the units' disc, a driving high tooth 120 finds itself opposite a driven tooth 503. This arrangement thus makes it possible to ensure that the short tooth 503 will always be driven by the long tooth 120 rather than by another other tooth 121. It is thus possible to re-establish the relative angular position of the two organs 1 and 50 simply by letting the units' disc 1 turn sufficiently long or by turning it manually by means of the date correction stem.

FIG. 6 also illustrates a preferred embodiment of the jumper 51 that pivots around a staff 512 and presses by means of a spring element 510 on the star wheel 50. According to the invention, the jumper's shape allows it to press in resting position on the rear side 5010 of a tooth of the star wheel 50 and on the front side 5011 of a non adjacent tooth; in order to limit friction, the contact with the intermediary tooth 501 is null or in any case limited to a small surface.

Resting on the rear side 5010 makes it possible to prevent the star wheel from turning in the opposite direction from that which is desired; resting on the front side 5011 allows the jumper 51 to be raised when the star wheel is driven in rotation by the units' disc 1. The jumper rests on three adjacent teeth, or possibly on two non-adjacent teeth even when one or several teeth opposite the jumper are of lower height.

In the indexing position illustrated in FIG. 6, the jumper 51 is about to be lifted by the front portion 5011 of the last tooth in contact with the jumper. However, in the preceding indexing position, this last tooth is a short tooth 503; in this case, the shape of the front side 5031 of this tooth does not allow it to lift the jumper 51, which is then raised by the front side 5014 of the intermediary tooth resting on the jumper's portion 513.

A pin 511 perpendicular to the plane of the jumper and the movement's bottom moves in a slide way 500 (represented in FIGS. 2, 5 and 6) machined in the wheel 52, whose shape prevents the pin 511 from jumping directly from one interstice 502 to a non-adjacent interstice between two teeth of the star wheel 50. The shape of the slide way 500 thus approximately marries the contours of the star wheel 50 in order to force the pin 511, and thus the jumper 51, to move up to the bottom of the interstice 502 between two teeth. The risk of the star wheel 50 being incremented by two steps when it is actuated by the teeth 120, 121 of the units' disc 1 is thus limited.

The examples described here above concern gears with driving and driven organs comprising each two distinct tooth heights; the invention is however not limited to this embodiment and the one skilled in the art will understand the advantages that can be achieved with gear organs having more than two tooth heights. For example, it would be possible to use three tooth heights on each wheel with different possibilities of mutual gearing.

The invention claimed is:

1. A gear for watch movement, including:

a driving organ, said driving organ being provided with z1 first teeth and z2 second teeth, the height and/or position of the second teeth being lower than the height of the first teeth a driven organ, said driven organ being provided with z3 third teeth and z4 fourth teeth, the height and/or position of the third teeth being greater than the height of the fourth teeth, the z1 first teeth allowing the z3 third teeth as well as the z4 fourth teeth to be driven, the z2 second teeth allowing however only the z3 third teeth but not the z4 fourth teeth to be driven.

2. The gear of claim 1, wherein said driving organ is a rotating organ.

3. The gear of claim 2, said driving organ being a wheel.

4. The gear of claim 3, said driving organ actuating a temporal phase indicator.

5. The gear of claim 4, said driving organ being a day of the month display mobile.

6. The gear of claim 1, wherein said driving organ actuates a first mobile bearing at least certain units' digits of the days of the month, a second mobile bearing at least certain tens' digits of the days of the months, said mobiles being arranged and placed so that, for at least certain dates, the day of the month displayed to the user corresponds to the combination of unit' digits borne by the first mobile and of tens' digits borne by the second mobile.

7. The gear of claim 1, said first and second teeth or said third and fourth teeth being constituted by portions protruding perpendicularly to the plane of said mobile, the height, position and/or shape of said first teeth being different from the height, position and/or shape of said second teeth.

8. The gear of claim 1, said first and second teeth or said second and third teeth being constituted by portions protruding perpendicularly to the plane of said gear organs, the distance between said protruding portions and the center of the corresponding gear organ being variable so as to produce the effect of teeth of variable height.

9. The gear of claim 1, wherein said driven organ is a rotating organ.

10. The gear of claim 9, said driven organ being a star wheel.

11. The gear of claim 9, said driven organ actuating a temporal phase indicator.

12. The gear of claim 11, said driven organ being mounted on the same axis as a driving wheel of a day of the month display mobile.

13. The gear of claim 1, wherein said driving organ and said driven organ are both rotating organs, said heights of the teeth being determined so that, after a certain number of indexing steps, each of the teeth of at least one of said organs always gears with the same tooth of the other of said organs.

14. The gear of claim 1, said tooth heights being determined so that, after a certain number of indexing steps, each of said third and fourth teeth of the driven organ is always driven by the same first or second tooth of the driving organ.

15. The gear of claim 1, wherein said tooth heights are determined so that, after a certain number of indexing steps, each of said first and second teeth of the driving organ always drives the same third or fourth tooth of the driven organ.

16. The gear of claim 1, wherein said driving organ and said driven organ are both rotating organs, said tooth heights being determined so that the relative angular positions of these two organs remain constant at each revolution.

17. The gear of claim 1, wherein the number of first and third teeth z1 and z3 are both equal to 1.

18. The gear of claim 1, wherein the numbers of second and fourth teeth z2 and z4 are both equal to 1.

19. The gear of claim 1, wherein one of said gear organs is held by a jumper acting one said teeth, said jumper being placed so as to prevent the undesirable rotation of said gear organ, a banking element being arranged so as to prevent said jumper from passing directly from one tooth of said gear element to a non adjacent tooth.

20. The gear of claim 19, wherein said banking element is linked to said jumper and moves in a slide way made so as to force said jumper to move close to the bottom of the interstice between two said teeth.

21. The gear of claim 19, wherein said jumper presses in resting position on the rear side of a tooth and on the front side of another, non-adjacent tooth.

22. The gear of claim 21, wherein an intermediary tooth lifts said jumper during rotation of said gear organ.

23. The gear of claim 1, wherein the linear pitch of the teeth on the two said organs is different.

24. The gear of claim 1, wherein the pitch of the teeth on at least one of said two organs is irregular.

25. The gear of claim 1, wherein said driving organ actuates a first mobile bearing a first sequence of digits, said driven organ actuating a second mobile bearing a second sequence of digits, said mobiles being arranged and placed so that, at least for certain dates, a day of the month displayed to the user corresponds to the combination of indication borne by the first mobile and of indications borne by the second mobile.

26. The gear of claim 25, wherein said mobiles are arranged and placed so that, for at least another date, the day of the month displayed to the user corresponds to the combination of two digits or of one digit and at least one space borne by the same mobile.

27. A gear for watch movement, including:

a driving organ, said driving organ being provided with z1 first teeth and z2 second teeth, the height and/or position of the second teeth being lower than the height of the first teeth a driven organ, said driven organ being provided with z3 third teeth and z4 fourth teeth, the height and/or position of the third teeth being greater than the height of the fourth teeth, the z1 first teeth allowing the z3 third teeth as well as the z4 fourth teeth to be driven, the z2 second teeth allowing however only the z3 third teeth but not the z4 fourth teeth to be driven.

28. A gear for watch movement, including:

a rotating driving organ, having first and second teeth with at least two different heights and/or shapes a rotating driven organ, having third and fourth teeth with at least two different heights and/or shapes, wherein the first teeth of the rotating driving organ allowing the teeth of both height and/or shape of the rotating driven organ to be driven, whereas the second teeth of the rotating driving organ allowing only the first teeth of the rotating driven organ to be rotated which are greater in height and/or shape, but not the second teeth of the rotating driven organ, said teeth being arranged so that, after a certain number of indexing steps, each of the teeth of at least one of said organs always gears with the same tooth of the other of said organs.

* * * * *